US005964164A

United States Patent [19]

Lechman

[11] Patent Number: 5,964,164

[45] Date of Patent: Oct. 12, 1999

[54] ADJUSTABLE MONITOR SUPPORT FOR FLAT MONITORS

[75] Inventor: John N. Lechman, Effingham, Ill.

[73] Assignee: Nova Solutions, Inc., Effingham, Ill.

[21] Appl. No.: 08/997,283

[22] Filed: Dec. 23, 1997

Related U.S. Application Data

[60] Division of application No. 08/451,026, May 31, 1995, Pat. No. 5,699,744, which is a continuation-in-part of application No. 08/428,860, Apr. 25, 1995, which is a continuation-in-part of application No. 08/135,103, Oct. 12, 1993, Pat. No. 5,408,939, which is a continuation-in-part of application No. 08/024,196, Feb. 26, 1993, Pat. No. 5,290,099, which is a continuation-in-part of application No. 07/907,193, Jun. 30, 1992, abandoned, which is a continuation-in-part of application No. 07/693,392, Apr. 30, 1991, Pat. No. 5,125,727, which is a continuation-in-part of application No. 07/595,864, Oct. 11, 1990, abandoned.

[51] Int. Cl.[6] ..... A47B 9/00

[52] U.S. Cl. ..... 108/109; 312/194; 211/133.5; 211/208.1

[58] Field of Search ..... 108/109, 107, 108/27; 312/194, 208; 211/133.2, 133.5, 181.1

[56] References Cited

U.S. PATENT DOCUMENTS

| | | | |
|---|---|---|---|
| Re. 34,266 | 6/1993 | Schairbaum . | |
| 2,309,435 | 1/1943 | Bitney | 211/133.2 |
| 2,970,702 | 2/1961 | Maslow . | |
| 3,012,185 | 2/1962 | Kowalczyk . | |
| 4,122,955 | 10/1978 | Celms | 211/133.3 |
| 4,590,866 | 5/1986 | Schairbaum . | |
| 4,755,009 | 7/1988 | Price et al . | |
| 4,836,478 | 6/1987 | Sweere . | |
| 5,071,204 | 12/1991 | Price et al . | |
| 5,087,010 | 2/1992 | Walters . | |
| 5,125,727 | 6/1992 | Lechman et al . | |
| 5,290,099 | 3/1994 | Lechman . | |
| 5,408,939 | 4/1995 | Lechman . | |
| 5,655,823 | 8/1997 | Schairbaum | 312/194 |
| 5,699,744 | 12/1997 | Lechman | 312/194 |

FOREIGN PATENT DOCUMENTS

| | | |
|---|---|---|
| 1106895 | 8/1981 | Canada . |
| 560 631 | 4/1975 | Switzerland . |
| 659 370 | 1/1987 | Switzerland . |

*Primary Examiner*—Peter M. Cuomo
*Assistant Examiner*—Gerald A. Anderson
*Attorney, Agent, or Firm*—Olson & Hierl, Ltd.

[57] ABSTRACT

An improved adjustable monitor support assembly is provided that utilizes a plurality of interchangeable side support assemblies and monitor supporting shelf assemblies. Each such shelf assembly is engageable with each pair or side support assemblies. Thus, a particular pair of side support assemblies can be used with either a monitor supporting shelf subassembly structure for a conventional monitor or a monitor supporting shelf subassembly structure for a flat LCD type monitor.

3 Claims, 5 Drawing Sheets

ADJUSTABLE MONITOR SUPPORT FOR FLAT MONITORS

RELATED APPLICATIONS

This application is a division of U.S. Ser. No. 08/451,026 filed May 31, 1995, now U.S. Pat. No. 5,699,744, issued Dec. 23, 1997, which application is a continuation-in-part of U.S. Ser. No. 428,860 filed Apr. 25, 1995, which is a continuation-in-part of U.S. patent application Ser. No. 135,103 filed Oct. 12, 1993, now U.S. Pat. No. 5,408,939 issued Apr. 25, 1995, which is a continuation-in-part of U.S. patent application Ser. No. 024,196 filed Feb. 26, 1993, now U.S. Pat. No. 5,290,099 issued Mar. 1, 1994, which is a continuation-in-part of U.S. patent application Ser. No. 907,193 filed Jun. 30, 1992, now abandoned, which is a continuation-in-part of U.S. Ser. No. 693,392 filed Apr. 30, 1991, now U.S. Pat. No. 5,125,727 issued Jun. 30, 1992, which is a continuation-in-part of U.S. patent application Ser. No. 595,864 filed Oct. 11, 1990, now abandoned.

FIELD OF THE INVENTION

This invention relates to an improved adjustable monitor support assembly that is adapted for supporting for a monitor of the flat type, this assembly being adaptable for use in various work stations of the type having a transparent surface portion through which such a supported monitor can be viewed.

BACKGROUND OF THE INVENTION

A new and very useful type of adjustable underdesk monitor support assembly for a computer work station structure (that can be in a desk-like form or other working configuration) is provided in Lechman et al. U.S. Pat. No. 5,125,727. This support assembly permits a monitor so supported to be viewable through a transparent portion (or window) in the top flat top working platform of the work station structure. This type of monitor support assembly is well suited not only for use in work stations of the free standing desk type and the like, but also in work stations of the type that are incorporated into a modular structure or working environment (see, for example, Lechman et al. U.S. Ser. No. 778,333 filed Oct. 17, 1991).

Recently, so-called flat monitors have been coming into wide spread usage. In contrast to conventional monitors (which are cathode ray tube display devices (CRTs) that incorporate scanning focused electron beams that move in a scanning or raster pattern transversely relative to the beam path over phosphor screens configured as spherical segments), conventional flat monitors are liquid crystal display devices (LCDs). In a monitor LCD device, the picture raster is constructed of a rectangular metal oxide semiconductor (MOS) switching matrix. At present, such a matrix conventionally has from about 240 to about 600 horizontal elements and from about 200 to about 400 vertical elements. The gates of all the thin-film transistors (TFTs) in a given horizontal row are connected to a common bus. Vertical scan (row addressing) is produced by driving the gate buses from a shift register. Horizontal scan, which contains the video information, is more difficult, but is achievable by breaking a given line of video into the same number of pieces as there are pixels in the horizontal row and storing in sample-and-hold (S/H) stages which all drive their respective drain bus lines simultaneously, thus creating a line sequential display. The information on a drain is changed only once for each horizontal period (typically 63.5 $\mu$s).

A flat monitor typically has a generally flat LCD viewing screen that is viewable through one face of an associated generally flattened rectangular case (or housing screen) of shallow thickness. Characteristically, the case of a flat monitor occupies substantially less volume and also has substantially less total weight with a flat monitor housed therein than the case of a conventional CRT type monitor with a conventional monitor housed therein that has a corresponding screen size.

For usage in a work station that is equipped with a transparent windowed flat working surface and with an interiorly positioned monitor which is supported for viewability by a seated station user through the window, a flat monitor is perceived by some to be desirable because of size, transportability (particularly in combination with a laptop or notebook computer) and related considerations.

Because of the desirable features and advantages of the adjustable underdesk monitor support assemblies provided in Lechman et al. U.S. Pat. No. 5,125,727 and in others of the above referenced related applications, it would be advantageous to adapt such assemblies for ready and convenient use in supporting flat monitors. The present invention provides an improved adjustable monitor support assembly that is so adapted.

SUMMARY OF THE INVENTION

The present invention provides an improved adjustable monitor support assembly that is particularly well adapted for positioning and supporting a flat monitor means or the like under a transparent portion in the working platform of a work station.

The adjustable support assembly of this invention can, if desired, be used to support either a flat monitor of the LCD or like type, or a conventional CRT type monitor. To achieve this objective, the invention further provides and utilizes a plurality of various different monitor supporting shelf subassemblies that can each be interchangeably used with an adjustable monitor support assembly to support selected monitors.

The present adjustable monitor support assembly can be utilized in various work station environments and can be variously associated with different work station structures. For one example, an adjustable monitor support assembly of this invention can be associated with a desk-type work station structure having a knee hole. In such an association, the adjustable monitor support assembly can (relative to the work station) itself be, for example, top supported by the working platform, floor supported, side supported by the adjacent panels of pedestal means or the like that define opposite sides of the knee hole, or some combination thereof. For another example, an adjustable monitor support assembly itself can be self supporting yet integrally incorporated into a combination structure that includes a windowed flattened top platform member, and, optionally, back and/or side upright panel members, so that the combination structure can function as a modular work station which is adapted for use in a cubicle or other working area.

An adjustable monitor support assembly of this invention utilizes when in an assembled and operative form a selected monitor supporting shelf subassembly structure. Such a monitor supporting shelf subassembly structure is itself believed to be novel and inventive.

One monitor supporting shelf subassembly structure of this invention is particularly well adapted for supporting a flat LCD type monitor.

Another monitor supporting shelf subassembly structure of this invention is particularly well adapted for supporting a conventional CRT type monitor.

A monitor supporting shelf subassembly structure of this invention that is adapted for supporting a flat-type monitor is characteristically provided with a preferably flattened monitor bottom supporting shelf. Along each of the opposite lateral sides of the monitor bottom supporting shelf is an upright side support frame means that extends preferably generally perpendicularly and downwardly relative to the monitor bottom supporting shelf. Each of these upright side support frame means, in turn, is provided with a plurality of longitudinally outwardly extending stub shaft means. Preferably the stub shaft means are defined by the terminal portions of a plurality of wires which extend longitudinally preferably across the bottom supporting shelf in preferably transversely spaced relationship to one another. This shelf subassembly structure is adjustably interconnected by connector means through the stub shaft means with adjacent portions of each respective one of a pair of side supports of the adjustable monitor support assembly.

A monitor supporting shelf subassembly structure of this invention that is adapted for supporting a conventional CRT type monitor is characteristically provided with a preferably flattened monitor bottom supporting shelf having an integrally associated and preferably flattened monitor back supporting member that angularly upstands (preferably perpendicularly) from the rear edge region of the bottom supporting shelf. A plurality of preferably transversely spaced, longitudinally extending wire members that are associated with the bottom supporting shelf and/or the back supporting member are provided. Each of these wire members terminates at its respective-opposite ends in outwardly extending stub shaft means. The stub shaft means are located along and adjacent to the respective opposed lateral sides defined by the bottom supporting shelf and the back supporting member. This shelf subassembly structure is adjustably interconnected by connector means through the stub shaft means with adjacent portions of each respective one of a pair of side supports of the adjustable monitor support assembly.

The adjustable monitor support assembly incorporates a pair of side support structures. Each side support structure member of which extends vertically beneath the working platform of a work station. In the assembled adjustable monitor support assembly, preferably each side support extends downwardly from a location that is generally adjacent to a different opposite side of a transparent window portion in the working platform. Each side support is also located adjacent to, but on a different opposite side of, a selected monitor supporting shelf subassembly. In accord with the invention, a pair of side supports that is utilized in a given adjustable monitor support assembly can be variously structured, particularly depending upon the intended use environment in a work station. An adjustable monitor support assembly of this invention can be used with various different monitor supporting shelf subassemblies that are themselves each adapted for supporting a particular type of monitor, such as a conventional CRT type monitor or a flat LCD type monitor.

For example, one pair of side support members that is employed in an adjustable monitor support assembly of this invention can be variously associated with various mounting means for association with work station components. Such pair of monitor side support structures is preferably structured and adapted for association with a work station structure that is a member of a class of work station structures.

Another pair of monitor side support structures is structured and adapted to as to be self supporting (or "free standing") and is adapted also to uphold a windowed working platform. Such a pair of side support structures can optionally include side support interconnecting means so that the pair does not need further associated side, back or bottom components to be self-supporting.

In the present invention, a selected pair of side support members, after incorporation into a particular work station, is usable interchangeably with various individual monitor supporting shelf subassembly structures including particularly a shelf subassembly structure that is adapted for supporting a flat monitor. A relatively small number of interchangeable different side support members and different monitor supporting shelf assemblies provide a class of adjustable monitor support assemblies that have interchangeable components and that have wide potential utilization capability in the field of work stations having a monitor supported under a windowed working platform. Thereby, the combination of an inventive adjustable monitor support assembly of the invention that is used in combination with an inventive adjustable monitor supporting shelf subassembly structure of the invention achieves versatility as well as savings in component fabrication, installation and use costs.

Advantageously, the adjustable monitor support assembly and the monitor supporting shelf subassembly structures can be used variously in modular work station structures, in free-standing work station structures, in supported work station structures, in retrofit applications for previously fabricated conventional desks, podiums, etc., and in like work stations applications.

The inventive adjustable monitor support assemblies and the inventive monitor supporting shelf subassembly structures are simple, strong, reliable and sturdy, and they require substantially no maintenance. Also, they provide superior heat dissipation capability for an operating monitor supported thereby.

The inventive adjustable monitor support assemblies and the inventive shelf subassembly structures can each be comprised of various structural materials preferably including wire members. Metal constructional components are presently preferred. An inventive adjustable monitor support assembly, and an inventive monitor supporting shelf subassembly, can each be formed of interwelded wire members.

For example, a combination of peripherally extending, formed metal tubing of rectangular cross section with interconnected formed heavy wire members is useful for self-supporting side support structures, while formed, load-bearing wire members are useful for the monitor supporting shelf subassembly structures. Weldments are preferably provided at cross over locations between the wire members, and the wire members and the tubing. After formation, the heavy wire members of the side supports and the shelf subassembly structures are preferably overcoated with a plastic, nonconducting, and preferably somewhat elastomeric, coating. Such preferred metal materials provide durability, stability, load bearing capacity, excellent heat dissipation capability, electrical insulation (when so coated) and significant air circulation capacity.

For adjustably interconnecting a given shelf subassembly with a pair of shelf side support members, the connection means preferably as comprises locking block assemblies. Each locking block assembly is comprised of a pair of molded interconnecting plastic components, such as are disclosed in the above-identified related patent applications and patents.

Other and further objects, aims, purposes, features, advantages, embodiments, applications, variations and the like will be apparent to those skilled in the art from the accompanying specification, associated drawings and appended claims.

DETAILED DESCRIPTION

Figure 1:
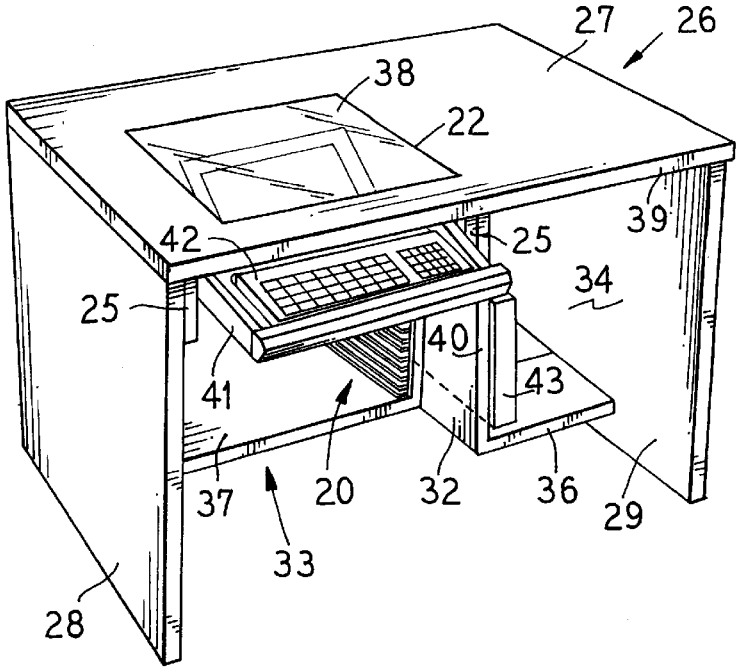
FIG. 1 is a perspective view of one embodiment of a monitor support assembly of this invention shown mounted under a desk-type work station this assembly incorporating a monitor supporting shelf assembly of this invention that is suitable for use in supporting a flat type monitor.
Figure 2:
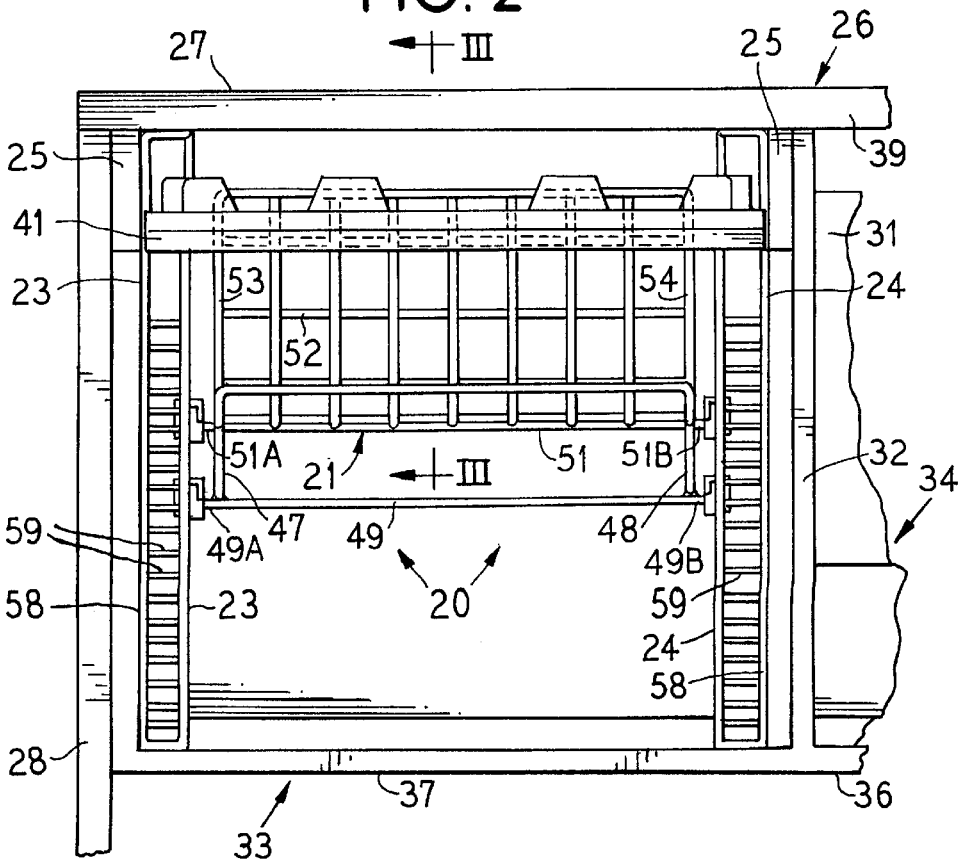
FIG. 2 is a front elevational view of the monitor support assembly and work station of FIG. 1, some parts thereof being broken away.

Referring to FIGS. 1–5, there is seen an embodiment 20 of a monitor support assembly of this invention. The monitor support assembly 20 incorporates a monitor supporting shelf subassembly structure 21 that is adapted for supporting a flat-type of monitor 22 and a pair of side support members 23 and 24 that support the structure 21. The monitor support assembly 20 is shown in functional association with an illustrative desk-type of work station 26.

The work station 26 has a top, flat generally horizontally extending rectangular top platform member 27 that is supported in spaced relationship to a floor surface by a pair of laterally spaced vertical side wall members 28 and 29. Side wall members 28 are joined together by a vertical back wall member 31 (see FIG. 5) which has an air space 30 (see FIG. 3) defined between its top edge and the underside of platform member 27. The work station 26 further includes an interior vertical support partition member 32 that is joined to back wall member 31 and platform member 27, that has a forward vertical edge 40 which is inset from the front or forward edge 39 of the top platform 27, and that has a bottom edge which is in spaced relationship to the floor. Partition 32 and walls 28 and 29 are conventionally fastened (means not shown) to adjacent portions of the underside of the top platform 27 and the back wall member 31. A kneehole 33 is defined between partition 32 and the side wall 28, and a storage area 34 is defined between partition 32 and the side wall 29. The storage area 34 is provided with a bottom shelf 36 that is mounted between the bottom edge of partition 32 and the inside of side wall 29. Also, another shelf 37 is provided between the bottom edge of partition 32 and the inside of side wall 28 in the rear interior of the kneehole 33. The work station 26 that is here illustratively used in combination with the monitor support assembly 20 can be variously configured and constructed without departing from the spirit and scope of this invention.

Inset into the platform 27 is a transparent window 38 which is located over the kneehole 23 in a transversely spaced relationship relative to the forward edge 39 of the platform 27.

The monitor support assembly 20 is mounted in the kneehole 33. The relationship between the monitor shelf subassembly structure 21 and the pair of side support members 23 and 24 is such that the monitor 22 as supported by the shelf subassembly structure 21 is inclined so that the screen of monitor 22 is upwardly angled and viewable through the window 38 by a user (not shown) who is seated at kneehole 33 and whose head is located above and in generally vertically spaced relationship to the forward edge 39.

Figure 3:
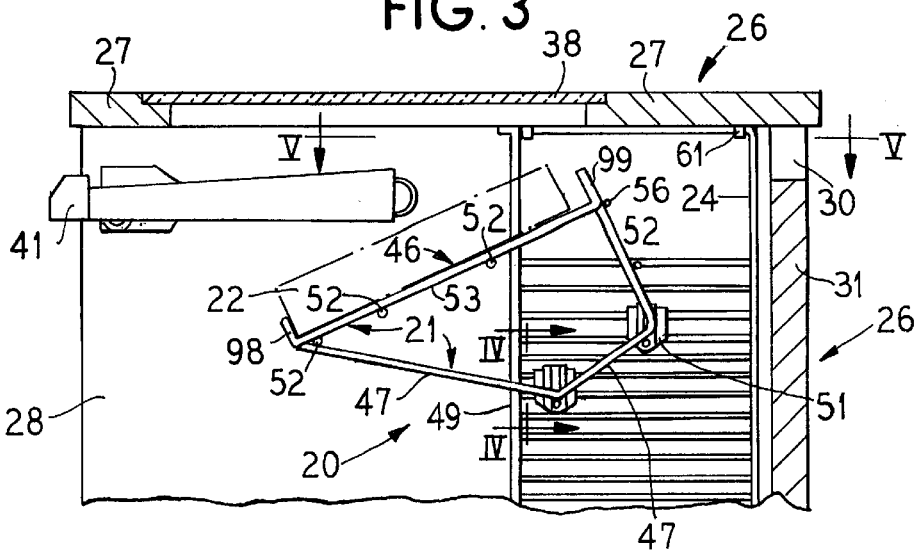
FIG. 3 is a vertical sectional view taken along the line III—III of FIG. 2.
Figure 4:
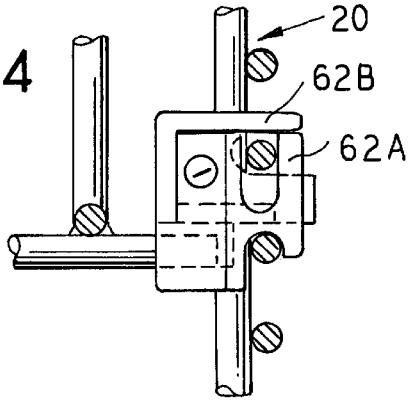
FIG. 4 is a fragmentary enlarged vertical sectional view taken along the line IV—IV of FIG. 3, some parts thereof being broken away and some parts thereof being shown in section.
Figure 5:
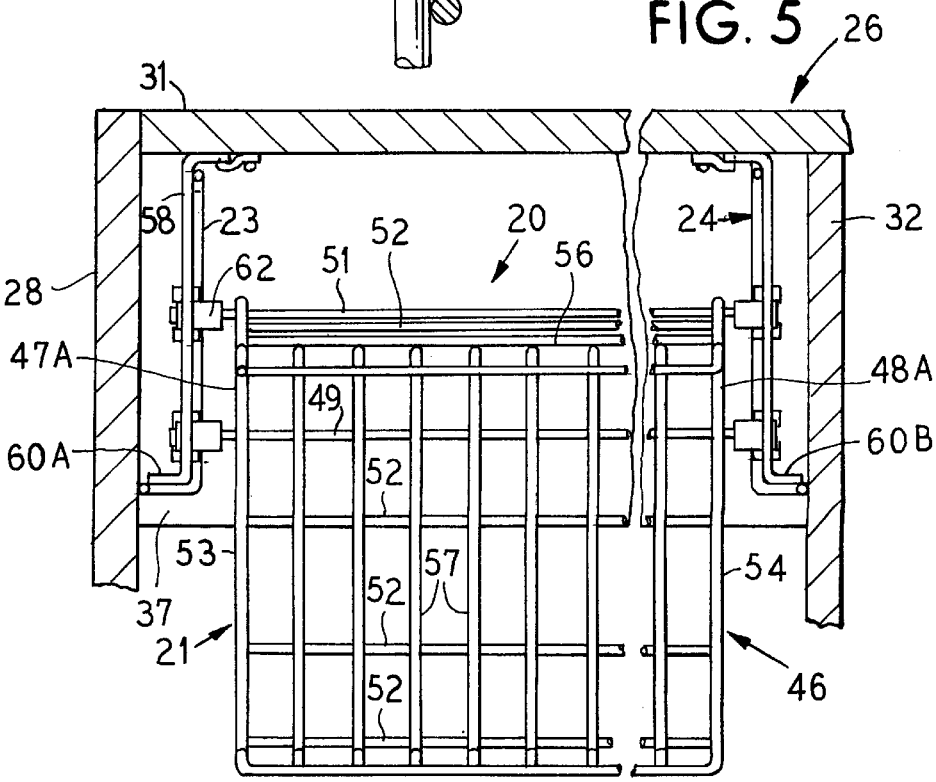
FIG. 5 is a fragmentary top plan view taken along the line V—V of FIG. 3 (the working platform being removed), some parts thereof being broken away and some parts thereof being shown in section.

Adjacent to and under the platform 27 and extending generally across the kneehole 33 is an optional but preferably slidably mounted, transversely short keyboard holding platform 41. Work station 26 is provided with a pair of spaced, transversely extending support plates 25 adjacent platform 27 with one plate 25 being conventionally mounted against side wall 28 and with the other plate being conventionally mounted against partition 32. Plates 25 support platform 41 and anchor the stationary portion of the platform slide means (conventional, not detailed). The platform 41 is transversely slidable from the open and fully outwardly extended position such as shown in FIG. 1 to a fully closed position such as shown in FIG. 3. In the open position, a keyboard 42 that is supported by the platform 41 can be operated by a user seated at kneehole 33. While any convenient subassembly can be used for platform 41 and its associated slide means, the structure shown in U.S. Pat. No. 5,205,631 issued Apr. 27, 1993 is now preferred.

A central processing unit (CPU), for example, a so-called laptop CPU 43, is interconnected with the keyboard 42 and with the flat monitor 22 by electrical cables (not shown). The laptop CPU 43 can be housed, if desired, in the work station 26; for example, it can rest on shelf 36 (as shown in FIG. 1). Alternatively, a CPU, if desired, can be remotely situated (relative to the work station 26, not shown).

A printer (not shown) that is interconnected with a CPU, such as laptop CPU 43, can also be housed, if desired, on shelf 36. Alternatively, the printer can be remotely situated (relative to the work station 26).

The monitor supporting shelf subassembly structure 21 incorporates a preferably flattened (as shown) monitor bottom supporting shelf 46 (see, for example, FIG. 3). Along the forward margin, and optionally but preferably (as shown) also along the rear margin, of shelf 46 is an upturned (preferably perpendicularly relative to shelf 46) flange 98 and 99, respectively. Along each of the opposite lateral sides of the shelf 46, an upright (preferably perpendicularly extending relative to shelf 46) shelf side support frame 47 and 48, respectively, is provided. Each side support frame 47 and 48 also extends downwardly from shelf 46.

The side perimeter of each side frame structure 47 and 48 is defined by a generally U-shaped heavy wire member which also extends upwardly and perpendicularly beyond the shelf 46 at the respective opposed corners of each lateral side, thereby to define the end edge and also the height of each of the flanges 98 and 99. This same wire member further then extends longitudinally to define the top edge of each of the flanges 98 and 99. The opposite ends of this wire abut at some location (not shown) where they are welded together. Longitudinally extending between the respective straight extending base portions 47A and 48A of each U-shaped wire frame 47 and 48 is a pair of straight brace wires 49 and 51 (each one adjacent a different end region of the base portions 47A and 47B). The brace wires 49 and 51 terminate at each end in a stub shaft projection identified as 49A, 49B, 51A and 51B that extends beyond the adjacent respective frame 47 and 48, respectively. Weldments (not detailed) are placed at all cross over locations between the individual wires. For additional support purposes, another longitudinal wire 52 extends between the side frame wires 47 and 48. Wires 49, 51 and 52 are preferably in transversely spaced, parallel relationship relative to one another with wire 52 being conveniently located between wire 51 and the rear edge of shelf 46.

The shelf 46 of structure 21 is provided with a pair of spaced parallel side wires 53 and 54, each one being transversely extending and located along a different one of the opposite lateral sides of the shelf 46, and each one extending between the respective U-shaped wire support frames 47 and 48. The rear edge of the shelf 46 is defined by a longitudinally extending wire 56 which extends between the frames 47 and 48 and which adjoins the rear ends of the respective side wires 53 and 54. A plurality of spaced, adjacent, parallel, transversely extending shelf wires 57 extend between the transversely extending side wires 53 and 54. Each shelf wire 57 has upturned opposite ends that terminally engages the wire defining the top edge of each respective flange 98 and 99. Each shelf wire 57 also adjoins the rear edge wire 56. Spaced, adjacent, parallel, longitudinally extending shelf support wires extend abuttingly under the wires 53, 54 and 57. Weldments (not detailed) are placed at all cross over and abutting locations between the individual wires.

The side support members 23 and 24 of the monitor support assembly 20 are regardable as being left and right mirror images of each other. Each is generally rectangularly configured and centrally flattened, and each is oriented vertically and disposed along a different opposed lateral end edge of a monitor supporting shelf subassembly structure, such as structure 21. Like the shelf structure 21, each support 23 and 24 is formed of heavy wire members which are interwelded together at points of contact therebetween.

Thus, each of the side support members 23 and 24 is defined by a perimeter defining wire 58. Along the forward longitudinal vertically extending side of each support member 23 and 24 the perimeter wire 58 is formed so as to extend outwardly and perpendicularly, thereby to define a pair of projecting flanges 60A (in member 23) and 60B (in member 24) that provide added structural support and rigidity for each of the respective side support members 23 and 24. As shown, for example, in FIG. 7, each side support 23 and 24 preferably has a notch or slot 65 defined in the lower outside perimeter edge portion thereof adjacent back mall 31 for purposes of possibly accommodating an optional longitudinally extending power cord and cable channel housing 70 or the like that can be associated with computer components used a work station 26 in a given installation.

In addition, each side support 23 and 24 has a plurality of horizontally extending, vertically spaced support member wires 59 that are welded at each of their respective opposite ends to wire 58 at each point of contact therebetween. In the region of flanges 60A and 60B, the individual support wires 59 are bent to define an L-configuration. The wires 59 thus provide a ladder-rung-like configuration; see, for example, the disclosure in Lechman et al. U.S. Pat. No. 5,125,727.

Figure 6:
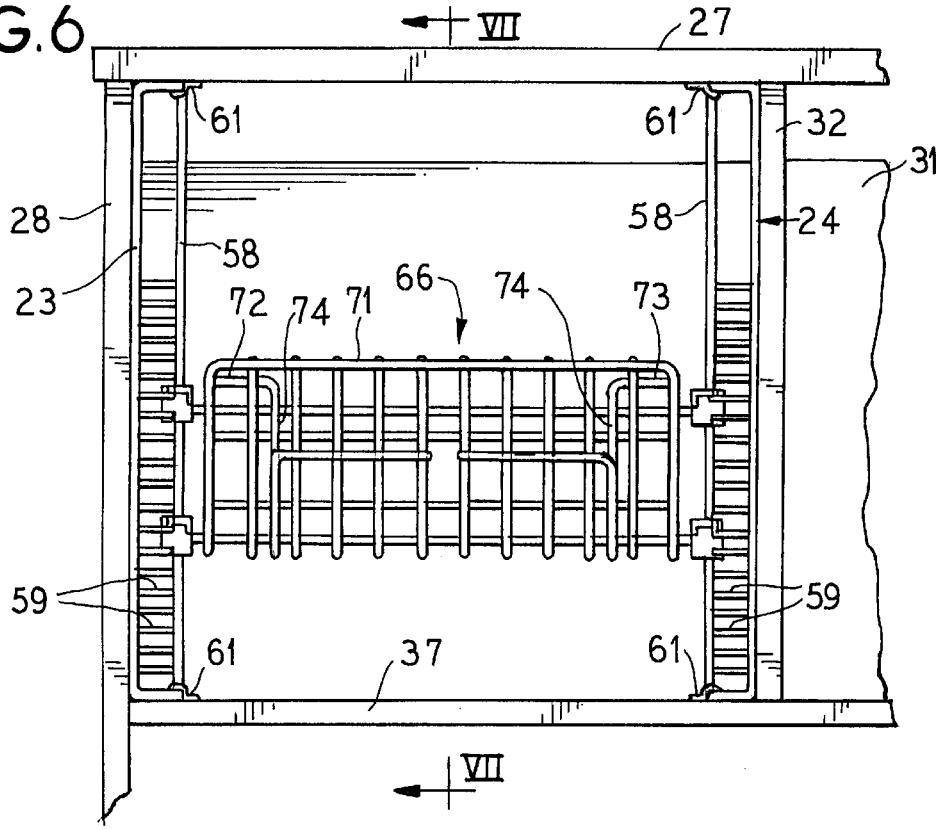
FIG. 6 is a fragmentary front elevational view of the monitor support assembly of this invention as shown in FIGS. 1–5, but showing this assembly in combination with an alternative monitor supporting shelf assembly that is suitable for use in supporting a conventional monitor.

The side support members 23 and 24 are conveniently mounted to the work station 26 by U-clamps 61 (and associated retaining screws) or the like to adjacent portions of the work station 26, such as to portions of the platform member 27 or of the shelf 37 or the like (see, for example, FIG. 6). Preferably, and as shown, each side support member 23 and 24 extends downwardly from a location adjacent platform 27 that is also adjacent location adjacent to one side of the window 38.

Figure 8:
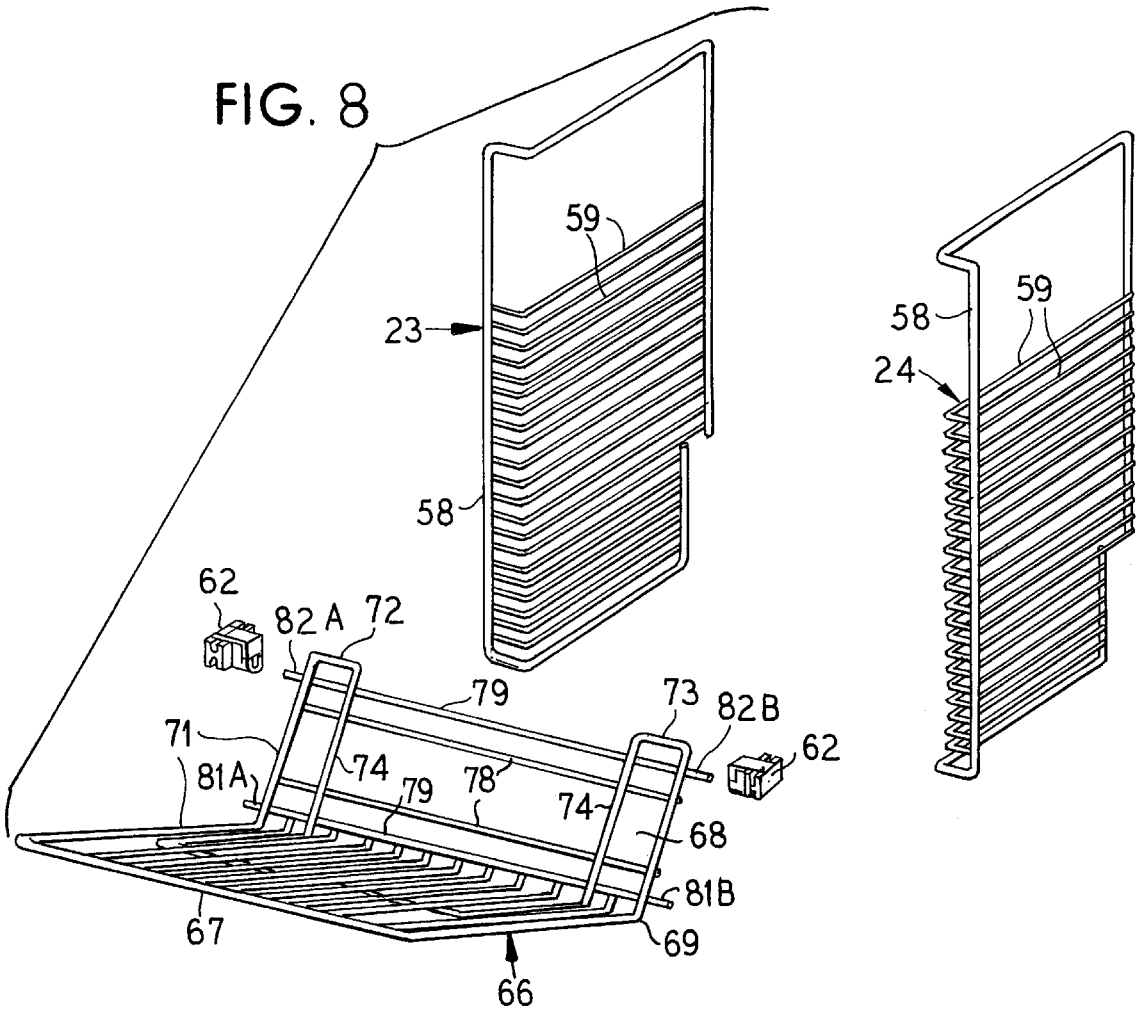
FIG. 8 is an exploded perspective view of the monitor support assembly shown in FIGS. 6 and 7.

The flat monitor supporting shelf subassembly structure 21 is adjustably connected to each of the side support members 23 and 24 by any convenient means. In the preferred mode of practicing this invention, the longitudinally projecting stub shafts 49A, 49B, and 51A are each adjustably positioned in a desired place along the side support members 23 and 24 by a locking block assembly 62 (only two of four locking block assemblies 62 are shown in FIG. 8). Each such locking block assembly 62, as disclosed in Lechman et al. U.S. Pat. No. 5,125,727, utilizes two interengaging components, which are preferably each formed of an injection molded plastic or the like, identified as rung block 62A and locking block 62B. Each such assembly 62 thus supports a different one of the stub shafts 49A, 49B, 51A and 51B and connects same to an adjacent portion of a selected pair of the rung wires 59. Thus, the structure 21 is adjustably supported by the side support members at various positions and angles. The flat monitor 22, as supported on the shelf 46 of structure 21, is thus positionable at a desired position and inclination angle for viewing a supported flat monitor 22 through the window 38.

Figure 7:
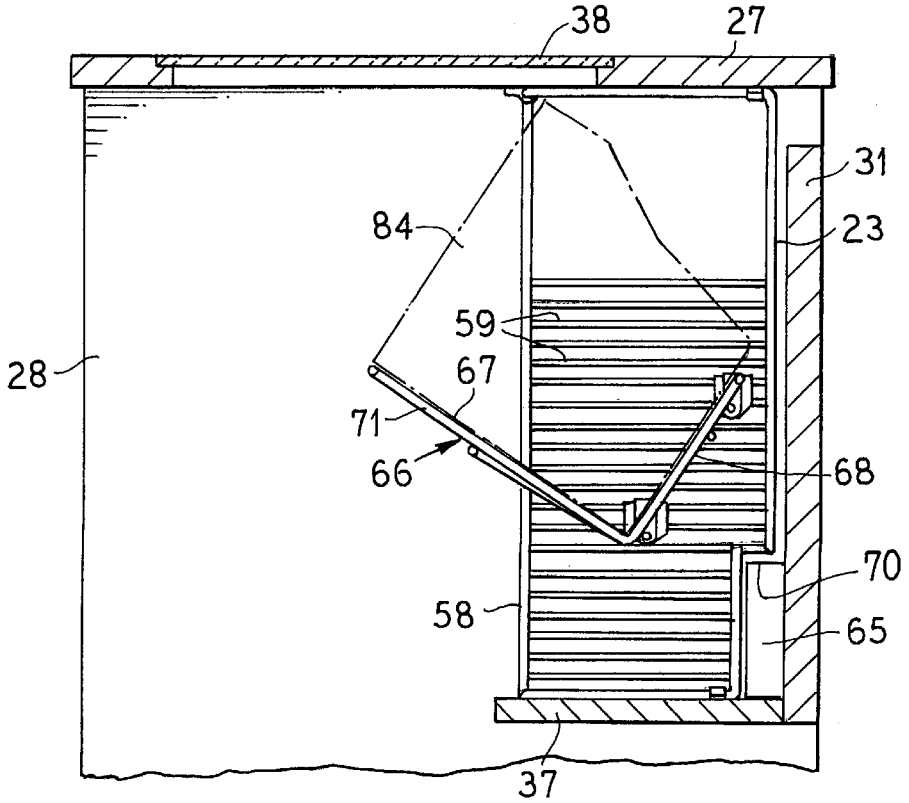
FIG. 7 is a transverse vertical sectional view taken along the line VII—VII of FIG. 6.

When it is desired to support a conventional monitor 84 (as shown in phantom in FIG. 7) by the same pair of side support members 23 and 24 in place of flat monitor 84, the monitor supporting shelf subassembly structure 21 is disassociated from the side support members 23 and 24 by removing the locking black assemblies 64 and is replaced by another shelf subassembly structure, such as the monitor supporting shelf subassembly structure 66 shown in FIGS. 6, 7 and 8.

The monitor supporting shelf subassembly structure 66, like monitor supporting shelf subassembly structure 21, is comprised of formed heavy wire members which are interwelded together at points of contact therebetween. The shelf subassembly structure 66 has a preferably flattened bottom support portion or member 67 and an adjoining preferably flattened back support portion or member 68 that integrally upstands or extends preferably perpendicularly from a rear edge region 69 of the bottom member 67. The shelf subassembly structure 66 incorporates a perimeter defining wire 71 which is bent upwards perpendicularly at rear edge 69. At each opposed lateral upper end edge 72 and 73, wire 71 is first folded (or bent) longitudinally inwardly and then is bent transversely to define two coplanar lengths of wire 74 extending from each end edge 72 and 73, as in the embodiment shown, so as to provide added strength for the back member 68. Back member 68 is further provided with a pair of parallel, longitudinally extending, vertically spaced back member supporting wires 78, and also with a pair of parallel, longitudinally extending, vertically spaced, shelf support wires 79.

One of the wires 79, which is adjacent the rear edge portion 69, provides at its opposite ends a first pair of opposed shelf support stub shafts 81A and 81B that extend laterally and longitudinally outwardly from the back member 68. The other one of the wires 79, which is spaced from, but is preferably adjacent to, the rear end edge portions 72 and 73, provides at its opposite ends a second pair of opposed shelf support stub shafts 82A and 82B that likewise extend laterally and longitudinally outwardly from the back member 68.

Longitudinally extending shelf support wires can be located, if desired, across portions of the bottom member 67. For example, alternatively, or in addition, a further pair of longitudinally extending spaced parallel shelf support wires (not shown) can be located across the bottom member 67 in transversely spaced relationship to each other. A still further variation, for example, involves placing one shelf support wires (not shown) under a forward portion of the bottom member 67 with the other (not shown) behind and adjacent to the upper and edge regions 72 and 73 of the back member 68. At least two pairs of shelf support stub shafts which, as used, preferably are spaced apart transversely from each other, but which need not be located at any particular portion of the shelf 66, as those skilled in the art will appreciate.

Also, the flat space between the longitudinal side edges of bottom member 67 (which side edges are in spaced, parallel relationship to each other) is provided with a plurality of spaced, parallel, transversely extending, bottom member supporting wires 83. In the region of rear edge 69, the individual wires 83 are each bent upwards and welded to at least one of each of the wires 78 and 79 (here illustratively wire 79), thereby to provide added rigidity for retaining the desired angular relationship between back member 68 and bottom member 67. Such rigidity is desirable in the preferred form of the monitor support shelf structure 66 shown where the bottom support member 67 is cantilevered from back support member 68 and is not otherwise held or supported when an inclined monitor 84 rests on bottom member 67 and back support member 68. Thus, shelf member 66 is itself supported and held only by the respective opposed shelf support shafts 81A, 81B, 82A and 82B. The shelf member 66 is comparable to that shown and described in Lechman et al. U.S. Pat. No. 5,125,727.

The shelf member 66 is conveniently adjustably connected the side supports 23 and 24 by any convenient connection means, as those skilled in the art will readily appreciate. However, in the illustrated preferred mode of practicing this invention, each of the support shafts 81A, 81B, 82A and 82B is adjustably associated with a different locking block assembly 62 and with a selected pair of the rung wires 59. A conventional monitor 84 is thus positionable on shelf subassembly member 66 and supported thereby at a desired position and angle for viewing through the window 38.

Figure 9:
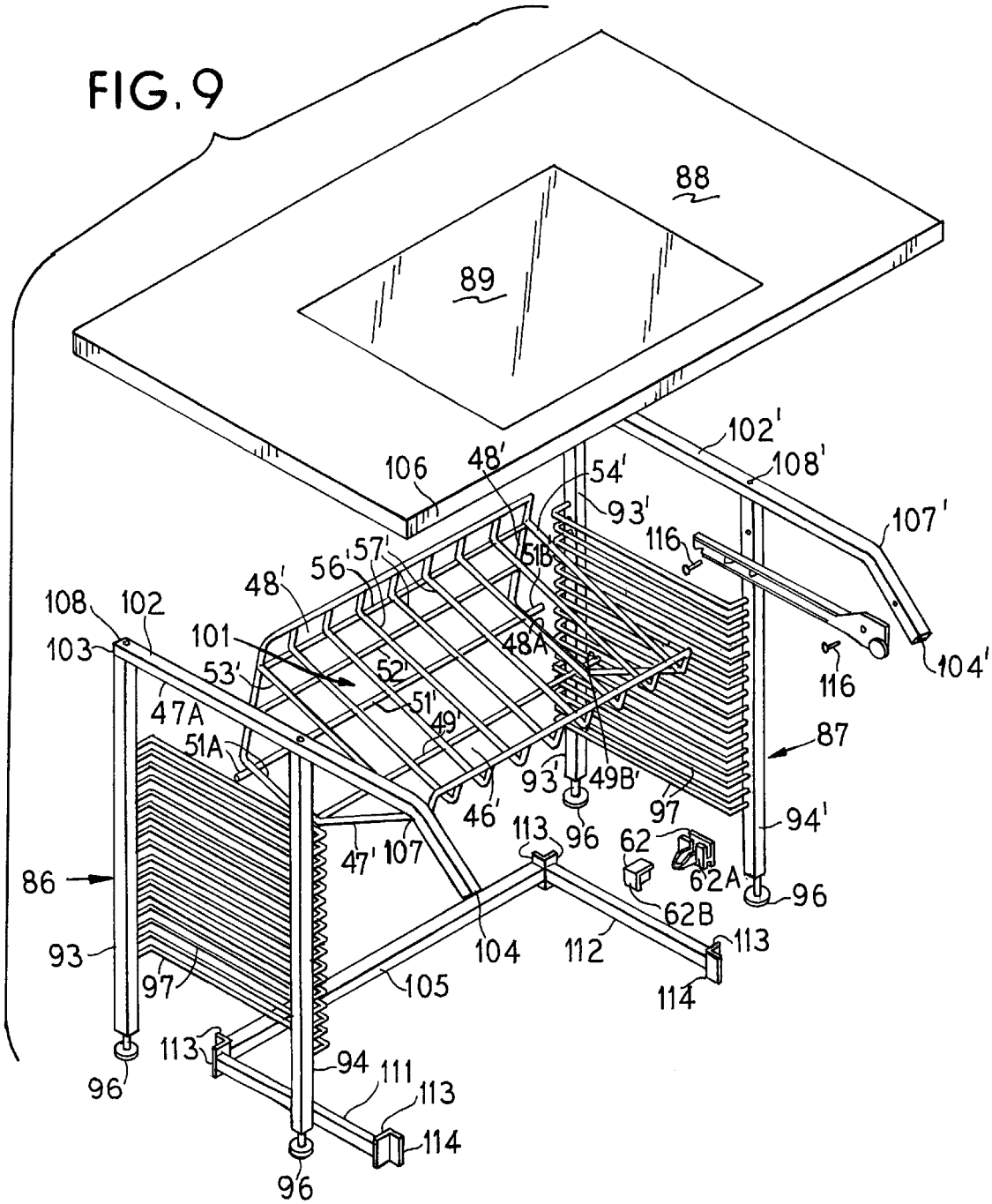
FIG. 9 is an exploded perspective view similar to FIG. 8, but showing an alternative embodiment of a monitor support assembly of the invention which illustratively employs a monitor supporting shelf assembly that is suitable for use in supporting a flat monitor.

Instead of employing a pair of supported side supports, such as side supports 23 and 24, one can employ a pair of independent or self-supportable side supports 86 and 87, such as shown in FIG. 9, which can support either the flat shelf subassembly structure 21 or a somewhat different embodiment of flat monitor shelf support subassembly 101 (as shown in FIG. 9). The side supports may be interchangeably used to support a monitor support shelf subassembly structure 66 or the like, if desired.

The respective side supports 86 and 87 are also adapted for supporting a top platform member 88. Platform member 88 has an aperture formed therein that has beveled or shouldered sides (not detailed) which are adapted to support and hold edge portions of a fitted inset transparent plate member 89 that, like window 38, is formed of glass, polyacrylic resin or the like.

The side supports 86 and 87 each extend vertically in spaced, parallel relationship to each other from contacting engagement with the adjacent portions of the underface of the top platform 88 to a support floor surface (not detailed). Each side support 86 and 87 is similar to the other except that support 86 is turned (oriented) 180° relative to support 87. The structure of support 86 is representative also of that of support 87.

Support 86 includes a pair or transversely spaced (relative to their orientation in the assembled monitor support assembly 91 shown in FIG. 9) legs 93 and 94 which preferably have a cross-sectionally square tubular configuration and which are preferably comprised of steel or the like. The length of each leg 93 and 94 is preferably equal to the other. Optionally, but preferably, the bottom of each leg 93 and 94 is interiorly fastened preferably by welding to a transversely extending nut (not shown) into which the threaded stem of an adjustable floor abutable foot 96 is threadably engaged so as to provide height adjustment and leveling adjustment capability for each leg 93 and 94 support 96 (with a corresponding foot 96 being provided for the respective legs of side support 87).

The entire mid region of side support 87 is provided with a plurality of vertically equally spaced, parallel, horizontally oriented C-shaped heavy wires 97 which are each butt welded (or the like) at each of their respective ends to the mid-region of a corresponding side face of each of legs 93 and 94. After the welding, which produces a ladder-like arrangement for the wires 97 relative to the legs 93 and 94, the wires 97 are preferably dipped or otherwise treated to coat each wire 97 with an electrically insulative, elastomeric polymeric coating, such as a vinyl plastisol, or the like. Support 87 is similarly provided with wires 97.

The shelf subassemblies 21 101, 66 or the like can be conveniently connected between and supported by the side supports 86 and 87 by any convenient means. However, a preferred connection in each instance is achieved by means of the adjustable locking block assemblies 62.

Interiorly and across the top end of each leg 93 and 94 a nut (not shown) is preferably secured by welding or the like. A cross bar 102 which is preferably crosssectionally square and tubular like legs 93 and 94 is preferably laid across each of the top ends of the legs 93 and 94. Preferably (and as shown) the rear end 103 of the bar 102 is coincident with the back side of the rear leg 93, and the forward end 104 of the bar 102 extends forwardly beyond the front leg 94 to a location which is preferably about just short of the anticipated forward edge 106 of the platform 88. At a location 107 which is preferably in transversely rearwardly spaced relation to forward end 104 along the bar 102, the bar 102 is bending downwardly. The angle of this bend at location 107 can vary, but is typically and preferably in the range of about 25° to about 50° with a bend angle of about 30° being presently most preferred. The bar 102 is provided with bores that are aligned with the upper end of each leg 93 and 94 so that screws 108 (preferably flat headed and mountable so as to be flush with the upper side of bar 102) are threadably engaged through such bores and with the nuts in the top end of each leg 93 and 94, thereby to mount the bar 102 to each of the legs 93 and 94. Bar 102' of support 87 is similar to bar 102 and is similarly connected to side support 87; corresponding parts and features are similarly numbered but with the addition of prime marks thereto for identification purposes.

To join and hold the side supports 93 and 94 in a desired fixed, longitudinally spaced, parallel relationship relative to one another, a horizontally oriented brace or cross support 109 is provided. Brace 109 is positioned in upwardly spaced, adjacent relationship to the underlying floor. Brace 109 extends between the back leg 93 of side support 86 and the back leg 93' of side support 87. The brace 109 is preferably C-configured and hence is provided at each of its opposite ends with perpendicularly transversely extending (relative to brace 109) extensions 111 and 112 which extend parallel to each other. Extension 111 extends between the legs 93 and 94, and extension 112 extends between the legs 93' and 94' of side support 87. To achieve an abutting relationship between leg sides and adjacent portions of the brace 109 and its extensions 111 and 112, the opposite ends of each of longitudinal main brace 55, extension 66 and extension 67 are provided with a vertical terminal plate 113 by welding or the like. Adjacent corners of the plates 113 and legs 93 and 93' are welded or otherwise mounted together to provide a continuous structure for the C-configuration of brace 109. Preferably each plate 113 extends above and below the associated brace 109, and also similarly for each of the extensions 111 and 112, so that, through bores therethrough, each plate 113 is mountable to the adjacent leg by screws (not shown) or the like. To brace the plates 113 against the legs on the outer end of each extension 111 and 112, each plate 113 is preferably associated with a perpendicularly extending side plate 114 by edge welding or the like.

Platform 88 is laid over the bars 102 and 102' and is fastened thereto by any convenient means. The downturned ends 104 and 104' of each cross bar 102 and 102' provides a forward mounting location for the forward end of each respective one of a pair of conventional fixed drawer slides 116 (one only shown). Each slide 116 extends horizontally and transversely and is adapted for lateral abutting engagement with a side of the individual respective legs 94 and 94'. Screws 117 or the like mount the slide 116. A keyboard holding platform, such as described in U.S. Pat. No. 5,205,631 (referenced above), is suitable and preferred, and is slidably associated with the slides 116.

The platform 88 or the side supports 86 and 87 can be conventionally fastened, if desired, to an adjacent vertical side or back wall (not shown), such as the wall components of a conventional modular office structure. The CPU and printer are conveniently remotely situated relative to the work station thus provided.

The side supports 86 and 87 can also be associated with a conventional desk structure, such as a desk structure (not shown) that is being retrofitted with a window in its work platform and with such a monitor support assembly in its kneehole (either with or without the bars 102 and 102' and the brace 109).

Component parts of the monitor support shelf subassembly structure 101 that are similar to corresponding parts of shelf structure 21 are similar numbered but with the addition of prime marks thereto for identification purposes. Shelf structure 101 is connected adjustably to side supports 86 and 87 similarly to shelf structure 21 by means of the locking block assemblies 62 (only one shown in FIG. 9).

Various other embodiments, applications, features, alternative but equivalent structures and the like will be apparent to those skilled in the art from this description of the present invention and no undue limitations are to be drawn therefrom.

What is claimed is:

1. A shelf subassembly for supporting a flat monitor in an adjustable monitor support, said shelf assembly comprising in combination:

(a) a generally rectangular, shelf member having an upper face and an opposed lower face, front and rear opposed edge regions, opposed lateral side edge regions, and an upstanding first flange extending along said front edge region;

(b) a pair of generally U-configured flattened frame members, each one of said frame members being:

(1) substantially vertically oriented, relative to said shelf member, (2) disposed in spaced, parallel relationship relative to the other frame member, and (3) adjacent to and connected with a different respective one of said lateral side edge regions, and including a connection device; and each of said frame members having respective opposite end portions whereby each opposite end portion is associated with a different corresponding corner region of the respective said lateral side edge region, so that each one of said U-configured frame members extends generally downwardly from said respective so connected lateral side edge region;

(c) at least two longitudinally outwardly extending stub shafts associated with each one of said U-configured frame members, and including an association device; and (d) said shelf assembly being formed of a plurality of wire members which are welded together at all contacting locations of said wire members with one said wire member continuously extending about the perimeter of said lateral said edge regions and said front edge region and also defining said rear edge region;

whereby said shelf subassembly is supportable by said stub shafts and said flat monitor is supportable by said shelf member.

2. The shelf subassembly of claim 1 wherein:

(a) said shelf member is comprised of:

(1) a perimetrically extending wire member that also defines the perimeter of said first flange member, (2) a plurality of longitudinally spaced, parallel wire members that transversely extend from said front edge region to said rear opposed edge region, and (3) at least one longitudinally extending reinforcing wire that extends beneath but adjacent to said parallel wire members from one said lateral side edge region to the other opposed said lateral side edge region, and (4) weldments joining said wire members together at each contacting location therebetween;

(b) each of said U-configured frame comprised of a unitary wire member that is welded to said perimeter wire at said opposite end portions; and (c) two of said stub shafts being so associated with each one of said frame members at a mid-region thereof, and each one of said stub shafts of each one of said frame members being in longitudinally aligned relationship relative to the other one of said stub shafts that is associated with the other said frame member and also being joined thereto by a longitudinally extending interconnecting wire device.

3. The shelf subassembly of claim 2 wherein said perimetrically extending wire further defines the perimeter of an upstanding second flange extending along said rear edge region.

* * * * *